US007121495B2

(12) United States Patent
Caamano

(10) Patent No.: US 7,121,495 B2
(45) Date of Patent: Oct. 17, 2006

(54) GENERATOR FOR POWERING A REEL FROM A FLUID FLOW

(75) Inventor: Ramon A. Caamano, San Carlos, CA (US)

(73) Assignee: Great Stuff, Inc., San Carlos, CA (US)

( * ) Notice: Subject to any disclaimer, the term of this patent is extended or adjusted under 35 U.S.C. 154(b) by 293 days.

(21) Appl. No.: 10/801,163

(22) Filed: Mar. 5, 2004

(65) Prior Publication Data

(51) Int. Cl.
*B65H 75/48* (2006.01)

(52) U.S. Cl. ..... 242/390.5; 137/355.2

(58) Field of Classification Search ..... 242/389, 242/390, 390.5, 390.8; 137/355.2
See application file for complete search history.

(56) References Cited

U.S. PATENT DOCUMENTS

| | | | | |
|---|---|---|---|---|
| 2,276,714 | A | 3/1942 | Brown | |
| 2,518,990 | A * | 8/1950 | Keener | 137/355.2 |
| 2,607,360 | A * | 8/1952 | Young | 242/390.5 |
| 2,621,870 | A | 12/1952 | Barton | |
| 2,898,605 | A * | 8/1959 | Pearson | 242/390.5 |
| 3,011,469 | A * | 12/1961 | Falkner | 242/390.5 |
| 3,471,885 | A * | 10/1969 | Cafaro et al. | 242/390.5 |
| 4,142,367 | A | 3/1979 | Guisti | |
| 4,186,881 | A | 2/1980 | Long | |
| 4,276,482 | A | 6/1981 | Crockett | |
| 4,276,900 | A | 7/1981 | Rosenqvist | |
| 4,352,025 | A | 9/1982 | Troyen | |
| 4,392,063 | A | 7/1983 | Lindquist | |
| 4,488,055 | A | 12/1984 | Toyama | |
| 4,533,835 | A | 8/1985 | Beckwith | |
| 4,538,761 | A | 9/1985 | Ruprechter et al. | |
| 4,731,545 | A | 3/1988 | Lerner et al. | |
| 4,746,808 | A | 5/1988 | Kaeser | |
| 4,839,039 | A | 6/1989 | Parsons et al. | |
| 5,249,631 | A | 10/1993 | Ferren et al. | |
| 5,427,350 | A * | 6/1995 | Rinkewich | |
| 6,036,333 | A | 3/2000 | Spiller | |
| 6,752,342 | B1 * | 6/2004 | Nagler | 242/390.5 |

FOREIGN PATENT DOCUMENTS

| | | |
|---|---|---|
| DE | 201 09 674 U1 | 8/2001 |
| EP | 0 509 151 A | 10/1992 |
| WO | WO 03/026995 A | 4/2003 |

OTHER PUBLICATIONS

International Search Report Mailed Jun. 28, 2005 in Corresponding PCT Application No. PCT/US2005/006679.

* cited by examiner

*Primary Examiner*—William A. Rivera
(74) *Attorney, Agent, or Firm*—Knobbe, Martens, Olson & Bear, LLP

(57) ABSTRACT

A generator is provided along a conduit that carries a man-made fluid flow. The generator generates electrical power that can be, e.g., used to charge a battery, rotate a reel, or to directly control a fluid flow control valve associated with the fluid flow. In the garden hose context, neither AC power nor frequent battery replacement is required because power from the generator can recharge the battery powering the valve and the reel.

26 Claims, 4 Drawing Sheets

GENERATOR FOR POWERING A REEL FROM A FLUID FLOW

BACKGROUND OF THE INVENTION

1. Field of the Invention

This invention relates generally to electricity generators and particularly to fluid-driven electricity generators.

2. Description of the Related Art

The use of conduits to carry fluids therethrough is well known in the art. For example, water hoses can be connected to a faucet on the outside of a house, the faucet having a traditional manual spigot or valve for turning the water flow on and off. A user can thus selectively allow pressurized water pumped from a well or supplied by a municipal water company to flow through the hose.

However, because hoses often extend many yards from the faucet, it is inconvenient for a user to have to return to the faucet to turn the water flow on and off. Manual devices, such as spray guns, are widely used to regulate water flow at the distal end of the hose so that the flow can be turned off and on without repeatedly returning to the faucet. However, it is undesirable to leave water turned on at the source when the hose is no longer in use for a number of reasons. Continual water pressure along the length of the hose tends to form leakage paths at joints between multiple lengths of hose, at the joint between the nozzle and the nozzle attachment, and at the joint between the hose and the faucet.

Electrical devices have also been developed to regulate water flow in hoses. For example, an electrically controllable valve responsive to remote control can be placed between the faucet and the hose. A remote control can then be operated to actuate the valve. A detailed description of such a remote control can be found in U.S. Provisional Application 60/455,229, filed Mar. 13, 2003, which is hereby incorporated by reference in its entirety.

Generators have been proposed for generating electricity from a flow of water in a conduit such as a hose or pipe. Various reeling mechanisms for reels not connected to a residential power grid are also known in the art. However, these mechanisms do not offer satisfactory means for powering the reeling of a hose. For example, these mechanisms either necessitate that the entire reel be in motion (e.g., a wheeled reel pulled behind a tractor) or that the water pressure be maintained at high levels at all times during which an operator could desire to spool or unspool the hose from/onto the reel drum. Accordingly, these prior art reeling mechanisms do not allow the reeling of a hose to be powered in situations where is it desirable for the entire reel to be stationary or where constant high water pressure is undesirable in the hose.

SUMMARY OF THE INVENTION

In accordance with a preferred embodiment, a system for spooling and unspooling a flexible conduit configured to contain a flow of a pressurized fluid is provided. The system includes a reel drum onto which the flexible conduit can be spooled and a generator. The generator is operatively connected to a flow path within the conduit. The generator is also configured to receive a pressurized fluid flow therethrough and convert kinetic energy of the pressurized fluid flow into electricity. A battery is operatively connected to the generator and is configured to receive and store the electricity. The system also includes a motor for selectively driving rotation of the reel drum. The motor is connected to the battery and is configured to receive electrical power from the battery.

In accordance with another preferred embodiment, a conduit managing system is provided including an electrically powered hose reel. The system also includes a fluid flow control device having a fluid flow path extending between an inlet and an outlet of the device. The fluid flow control device further includes an electrically actuated valve disposed in-line with the flow path. The valve is configured to selectively open or close the flow path. The control device also has electronics configured to actuate the valve. A generator is configured to convert the kinetic energy from a pressurized fluid flowing through the flow path into electricity. The system also includes an electrical circuit for delivering electricity from the generator to the fluid flow control device and the hose reel.

In accordance with yet another preferred embodiment, a hose control system is provided including a reel for spooling and unspooling a flexible fluid conduit. A motor is connected to the reel to drive rotation of the reel. An electrically actuated flow control device is configured to selectively allow a pressurized fluid flow therethrough. The system also includes a generator adapted to harness the energy of the pressurized fluid flow to electrically charge a battery connected to both the flow control device and the motor. The battery is configured to provide power to both the flow control device and the motor.

In accordance with another preferred embodiment, a method of spooling a hose is provided. A flow control device is connected to the hose. The device includes a flow path in communication with the hose, the device being configured to receive a pressurized fluid flow therethrough. The device further includes an electrically actuated valve in communication with the flow path. A generator is provided, at least a portion of the generator being disposed in the flow path. The generator is configured to convert kinetic energy of the pressurized fluid flow into electrical energy. A battery connected to the generator is charged with the electrical energy. An electrical connection from the battery to a hose reel is provided to electrically power rotation of the hose reel with the battery.

In accordance with another preferred embodiment, a method of reeling or unreeling a hose and regulating a pressurized fluid flow through the hose is provided. A flow control device connected to a hose is provided, the hose having a flow path. The energy of a pressurized fluid flow through the hose is harnessed to generate electricity. A battery is then charged with the electricity. The reeling or unreeling of the hose is powered with electricity from the battery. Electrical power from the battery is also provided to the flow control device to selectively allow flow through the flow path.

In accordance with another preferred embodiment, a method for electrically powering a reel from a pressurized fluid flow through a conduit is provided. The method includes providing a conduit defining a flow path configured to receive a pressurized fluid flow therethrough from a mechanical source. Energy of the pressurized fluid flow is harnessed to generate electricity. Rotation of the reel is then powered using the generated electricity.

DETAILED DESCRIPTION OF THE PREFERRED EMBODIMENTS

Figure 1:
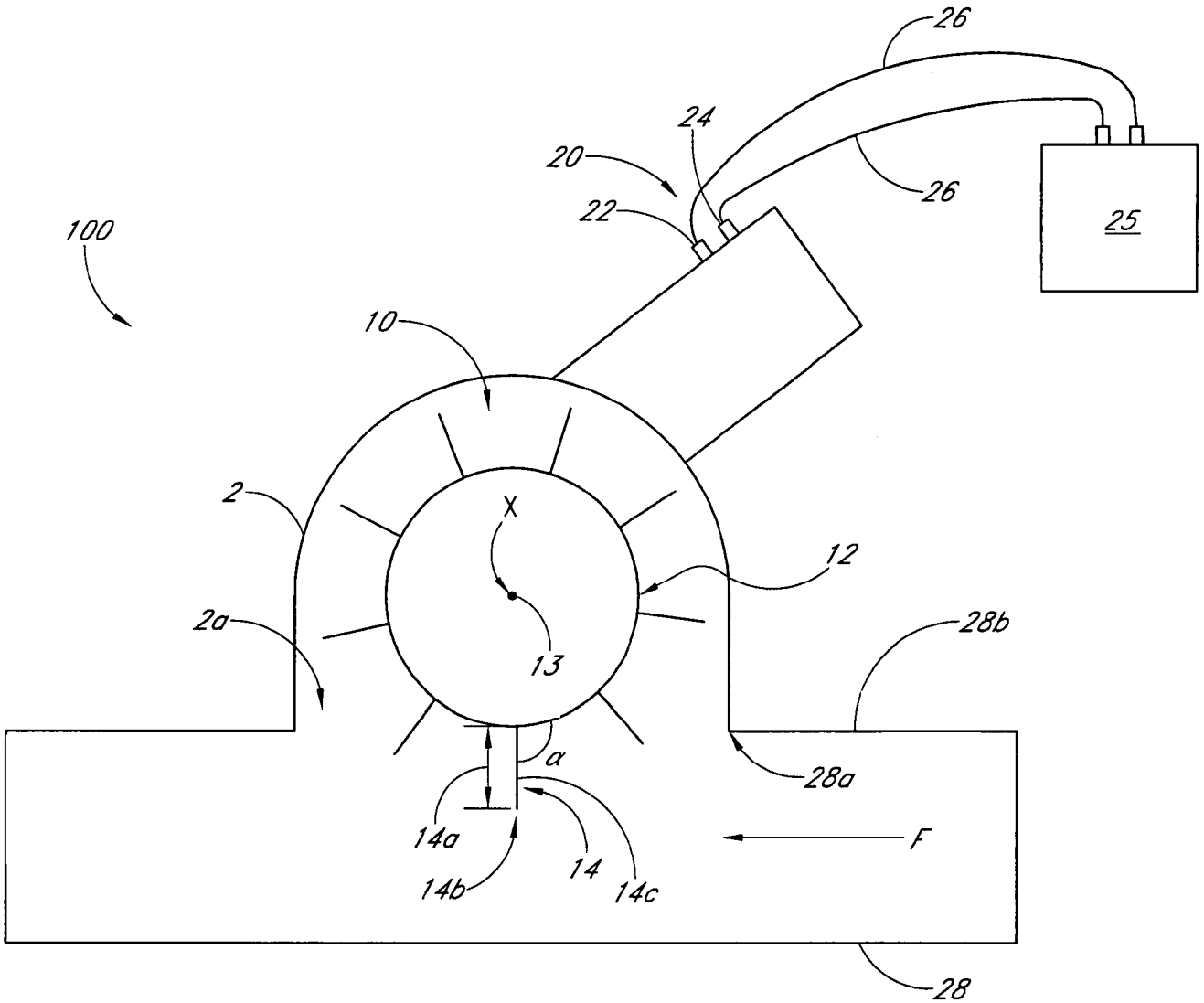
FIG. 1 is a schematic longitudinal cross-section of a generator, protruding into a fluid conduit, according to one embodiment of the invention.

Mechanically driven hose reels with electric valves for controlling fluid flow are known in the art. However, these reels do not teach generating electricity to power the rotation of the reel. For instance, U.S. Pat. No. 4,276,900 to Rosenqvist teaches an irrigation device employing a water-driven turbine connected to an electricity generator powering a valve in a water line. However, the Rosenqvist generator does not power the rotation of the hose reel. Instead, the water-driven turbine drives the rotation of the drum through a transmission link. Accordingly, the transmission link cannot drive rotation of the reel drum when there is little or no water pressure to drive the turbine. Preferred embodiments of the present invention address this problem by effectuating the rotation of a reel drum even when the water pressure is low, e.g., if the water source is turned off.

Generation of power from natural water flow is also well known in the art. For example, hydroelectric plants use the gravitational flow of water from a reservoir side of a dam to a body of water downstream of the dam to generate power. Said gravitational water flow strikes and turns blades of a turbine, which is attached to a generator by way of a shaft. The goal, of course, is generation of electrical energy from natural sources.

However, the inventors have realized that generation of electrical energy from flowing fluids can be useful, particularly in the context of controlling a reel, even when it is not an efficient manner in which to create electrical energy. In particular, there are situations in which it is difficult or impractical to supply electrical power, but in which there is a ready source of kinetic energy in the form of a flowing fluid. For example, the generators described herein harness the power of pressurized water flow from man-made sources. These man-made sources include water pumped from a well or made available by a municipal or local water company. A user normally accesses said pressurized or pumped water flow from man-made sources by turning on a faucet or the like. For example, the user can connect a hose to a faucet outside a house, the faucet having a traditional manual spigot or valve for turning the water flow on and off and selectively allowing the pressurized water to flow through the hose. Such pressurized water flow has power-generating potential that is generally not harnessed. In an alternate embodiment, the pressurized fluid powering the generator is pressurized air.

While illustrated in the context of pressurized water flow through garden hoses for household watering or washing applications, one of ordinary skill in the art will readily appreciate that the principles and advantages of the preferred embodiments are applicable to other fluid flows and products. For example, in addition to the illustrated liquid application, the fluid flow through a conduit (e.g., hose or pipe) can comprise compressed air for other applications. Additionally, the preferred embodiments can be used anywhere there is a fluid flow and the use of a separate power source is inconvenient or impractical.

FIG. 1 shows a schematic view of one embodiment of a generator 100. The generator 100 preferably comprises a housing 2 having an open end 2*a* and configured to house at least a portion of an impeller 10. The impeller 10 has a body 12 adapted to rotate within the housing 2 about an axis X that preferably passes through a center point 13 of the body 12. In the illustrated embodiment, the body 12 has a circular cross-section. However, the cross-section of the body 12 can have other shapes, such as oval, square and polygonal.

The impeller 10 also comprises at least one paddle 14 connected to the body 12 and extending away from the body 12. In the illustrated embodiment, the impeller 10 comprises a plurality of paddles 14 distributed about the body 12 circumference. Each paddle 14 preferably defines a length 14*a* from the body 12 to a free end 14*b* of the paddle 14. The paddles 14 are preferably integral with the body 12. However, in one embodiment, the paddles 14 can be removably connected to the body 12 via, for example, rivets, screws, hooks or the like. In another embodiment, the paddles 14 can be permanently attached to the body 12 via, for example, an adhesive like a resin or the like.

The impeller 10 is preferably operatively connected to at least one electrical terminal 20 of the generator 100. For example, the impeller 10 can connect to the at least one terminal 20 via a shaft (not shown). In the illustrated embodiment, the generator has two terminals 20, a negative terminal 22 and a positive terminal 24. However the generator 100 can have any number of terminals 20. The terminals 20 are preferably configured to transmit electrical energy generated by the generator to at least one electrical object connected thereto. In the illustrated embodiment, the terminals 20 are connected to a battery 25 via electrical wires 26. However, the terminals 20 can connect to other devices, such as an electrical motor (not shown) or an electrical actuator (not shown). Preferably, the terminals 20 and electrical wires 26 are kept dry, especially when used in a wet environment. For example, the terminals 20 and wires 26 can be housed in a housing (not shown) containing said electrical motor or electrical actuator.

In the preferred embodiment illustrated in FIG. 1, the housing 2 of the generator 100 connects to a conduit 28 so that the open end 2*a* of the housing 2 aligns with an aperture 28*a* on the surface 28*b* of the conduit 28. Preferably, the open end 2*a* is generally the same size as the aperture 28*a*. In the illustrated embodiment, the housing 2 is integral with the conduit 28. However, in another embodiment, the housing 2 can be removably attached to the conduit 28. For example, the housing 2 can comprise a section of hose or pipe (not shown) having connectors at its ends, each of said connectors being configured to connect the housing 2 to a conduit 28. For example, the connector can be a threaded male end (not shown) configured to connect with a threaded female fitting (not shown) of the conduit 28. The conduit 28 can be a hose, a pipe or the like.

As shown in FIG. 1, the impeller 10 is disposed in the housing 2 so that at least a portion of the length 14*a* of the at least one paddle 14 extends into the conduit 28 when the housing 2 is connected to the conduit 28. Preferably, only the paddles 14 extend into the conduit 28, not the body 12. The length 14*a* of the at least one paddle 14 that extends into the conduit 28 is selected such that it generates sufficient power for the purposes of the application (e.g., to keep a battery charged for purposes of powering a reel or actuating a control valve), but not so much that the flow is slowed down to the extent that it is no longer useful for the intended purpose of the fluid flow. For most fluid flow applications, in which electrical energy is to be generated simply out of convenience to minimize the need to replace batteries or avoid providing AC current to a wet environment, preferably between about 70% and 95% of the flow's kinetic energy is converted to electrical energy, more preferably between about 85% and 95%. The typical household water pressure is 40–60 psi. In one preferred embodiment, a 5 psi drop in water pressure is caused by slowing the flow path and 80–90% of the 5 psi drop in water pressure is converted into electricity.

The conduit 28 is preferably adapted to carry a pressurized fluid flow F therethrough. For example, the conduit 28 can be a hose having the required material characteristics to carry a fluid flow pressurized to a desired amount. In one embodiment, the conduit 28 can be made of a hard plastic, such as polypropylene or polyethylene. In another embodiment, the conduit 28 can be made of a rubber or metal.

In one embodiment, the housing 2, impeller body 12, and paddles 14 of the generator 100 are made of a hard plastic. However, any material commonly used for making generators can be used. For example, in one embodiment, the housing 2, impeller body 12, and paddles 14 can be made of a metal or metal alloy, such as aluminum and stainless steel.

The pressurized fluid flow F is preferably from a mechanical source, such as a pump or the like, not sources that pressurize water via gravity. For example, the pressurized fluid flow F can be a liquid, such as water pumped from a well or delivered to a user from a municipal or local water system. However, the pressurized fluid flow F is not limited to liquids and can comprise other fluids, such as gases. In another embodiment, the pressurized fluid flow F can be compressed air from a compressor.

In operation, the pressurized fluid flow F exerts a force on a surface 14*c* of the at least one paddle 14. In the illustrated embodiment, the surface 14*c* is generally planar. Preferably, the surface 14*c* is oriented at an angle $\alpha$ relative to the fluid flow F configured to maximize the transmission of the force from the fluid flow F to the paddle 14. The angle $\alpha$ varies as the impeller 10 preferably rotates. In the embodiment illustrated in FIG. 1, the angle $\alpha$ is about 90 degrees when the maximum portion of the length 14*a* extends into the conduit 28, so that the paddle 14 is generally orthogonal to the fluid flow F and receives the maximum amount of force from said fluid flow F. However, as the impeller 10 rotates, the angle $\alpha$ decreases, resulting in a decreased transmission of the force from the fluid flow F to the paddle 14. But the rotation of the impeller 10 preferably rotates another paddle 14 into a position generally perpendicular to the fluid flow F, which then receives the maximum amount of force from said fluid flow F, as discussed above.

The force exerted by the fluid flow F preferably causes the paddle 14 and the body 12 to rotate about the axis X. The rotation of the body 12 is transformed into electrical energy in a manner well-known in the art and transmitted to the terminals 20, as discussed above, to provide electrical energy to a variety of devices, such as batteries, electrical actuators and electric motors. Thus, an electrical path is provided from the generator, either directly to an electrical device associated with the fluid flow, or indirectly to such a device by way of a battery that stores the generated energy between operations of the electrical device.

Figure 2:
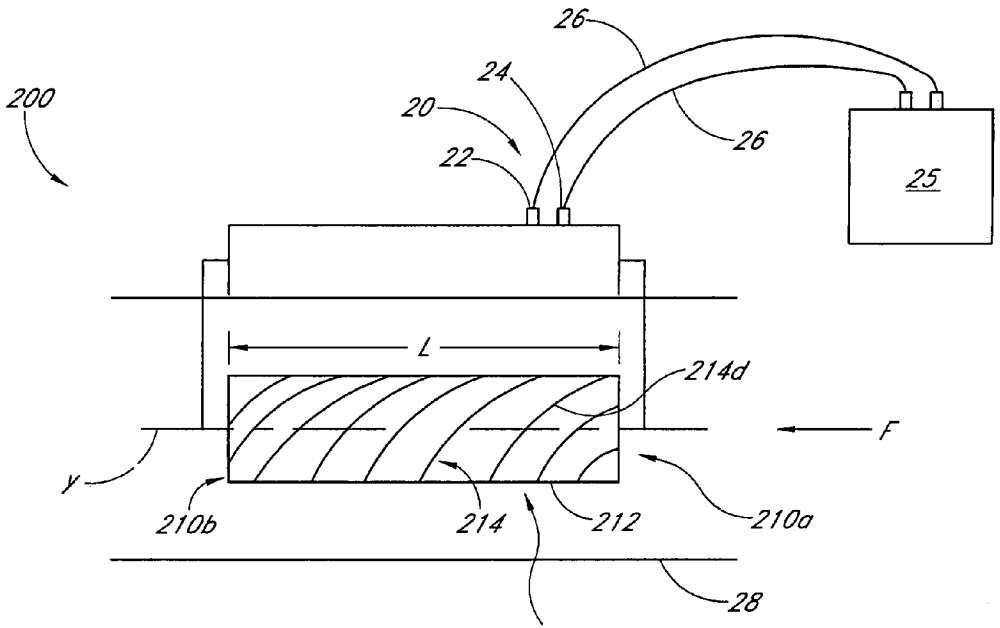
FIG. 2 is a schematic longitudinal cross-section of a generator within a conduit, according to a second embodiment of the invention.
Figure 3:
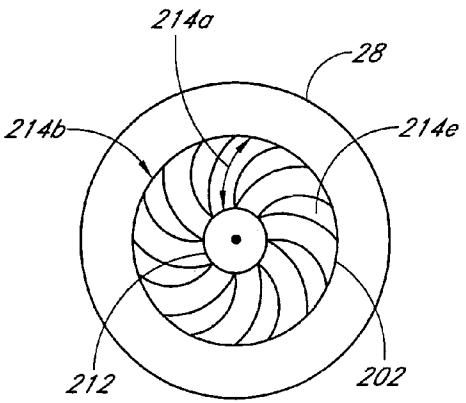
FIG. 3 is a schematic transverse cross-section of the generator and conduit of FIG. 2.

FIGS. 2–3 show a schematic of another embodiment of a generator 200. The generator 200 comprises a turbine 210 extending along a length L between a first end 210*a* and a second end 210*b* and having a body 212. The body 212 is disposed in the conduit 28, has a length L, and is preferably configured to rotate about an axis Y generally in-line with the pressurized fluid flow F. The body 212 is operatively connected to the terminals 20 of the generator 200, via, for example, a shaft (not shown).

The turbine 210 also comprises at least one vane 214 connected to the body 212 and extending away from the body 212. In the illustrated embodiment, the turbine 210 comprises a plurality of vanes 214. Each vane 214 preferably defines a length 214*a* from the body 212 to an end 214*b* of the vane 214. In one embodiment, the end 214*b* is a free end. In another embodiment, the end 214*b* connects to a housing 202 extending about the turbine 210 along the length L. Preferably, the housing 202 is cylindrical in shape. The length 214*a* is preferably curved. The vanes 214 also preferably extend in curved fashion along the length L. For example, the vanes 214 can extend as spirals along the length L. Preferably, the vanes 214 are shaped and oriented to efficiently transmit a force from the fluid flow F to the vanes 214.

The vanes 214 are preferably integral with the body 212. However, in one embodiment, the vanes 214 can be removably connected to the body 212 via, for example, rivets, screws, hooks or the like. In another embodiment, the vanes 214 can be permanently attached to the body 212 via, for example, an adhesive, a resin or the like.

As illustrated in FIG. 2, the at least one vane 214 preferably defines a surface 214*d* along the length L of the vane 214. The surface 214*d* projects a surface 214*e* along the axis Y generally orthogonal to the pressurized fluid flow F (see FIG. 3). The surface 214*d* is adapted to receive the force exerted thereon by the fluid flow F to efficiently transmit the linear force along axis Y from the fluid flow F to the rotation of the body 212 about the axis Y.

In one embodiment, the housing 202, turbine body 212, and vanes 214 of the generator 200 are made of a hard plastic. However, any material commonly used for making generators can be used. For example, in one embodiment, the housing 202, turbine body 212, and vanes 214 can be made of a metal or metal alloy, such as aluminum and stainless steel.

The force exerted by the fluid flow F preferably causes the at least one vane 214 and the body 212 to rotate about the axis Y. The rotation of the body 212 about the axis Y is transformed into electrical power in a manner well-known in the art and transmitted to the terminals 20, as discussed above, to provide power to a variety of devices, such as batteries, electrical actuators and electric motors.

Figure 4:
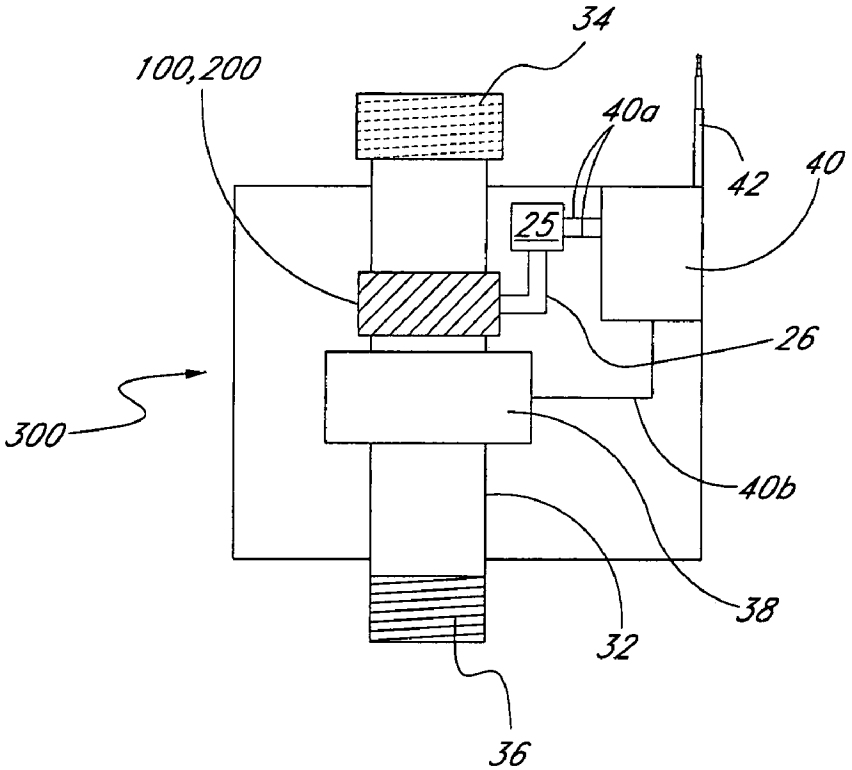
FIG. 4 is a schematic of a generator used to power a flow control device.

FIG. 4 illustrates the use of the generator 100, 200 in a flow control device 300. The flow control device 300 preferably comprises a fluid flow path 32 extending between an inlet 34 and an outlet 36. In one embodiment, the flow control device 300 can be connected between a hose (not shown), such as a garden hose, and a faucet (not shown). In a preferred embodiment, the flow control device 300 comprises the generator 100, 200. For example, at least a portion of the fluid flow path 32 can be defined by the conduit 28 (shown in FIGS. 1 and 2) to which the generator 100, 200 connects.

The flow control device 300 also comprises an electrically actuated valve 38 disposed in-line with the flow path 32 and an associated electrical signal receiver 40. For example, the valve 38 can be a motor-driven valve, pressure-activated valve, or solenoid valve. The skilled artisan will understand, in view of the disclosure herein, that there are a variety of different types of controllable (preferably electronically controllable) valves which can be employed with the embodiments disclosed herein. In one preferred embodiment, a solenoid valve and a pressure-activated valve are both employed, the pressure activated valve preferably reducing pressure within the conduit and, as a result, reducing power consumption when spooling or unspooling the conduit. The receiver 40 is preferably configured to receive an electromagnetic signal from, for example, a remote source. For example, the receiver 40 can receive the signal via an antenna 42 operatively connected thereto. Preferably, the receiver 40 communicates the signal via a line 40*b* to actuate the valve 38 between an open position and a closed position. Accordingly, the valve 38 can be selectively operated to regulate flow through the flow path 32. In one embodiment, the valve 38 is also capable of assuming one or more intermediate positions, i.e., positions that are between the completely open and completely closed positions, which allows for greater control of the fluid flow. In one embodiment, the valve 38 is continuously variable between its open and closed positions to preferably vary the size of a flow orifice (not shown) in the flow path 32. For example, the valve 38 can be a spool valve.

In one embodiment, the receiver 40 can be connected to the battery 25 via at least one wire connection 40*a*, wherein the battery 25 in turn connects to the terminals 20 (as shown in FIGS. 1 and 2) of the generator 100, 200. Accordingly, the generator 100, 200 charges the battery 25 while fluid flows through the flow path 32. The battery 25 in turn transmits power to the receiver 40, which signals the actuator to actuate the valve 38, as discussed above. In an alternate embodiment, the receiver 40 can connect directly to the terminals 20 of the generator 100, 200 via the at least one wire connection 40*a*.

Figure 5:
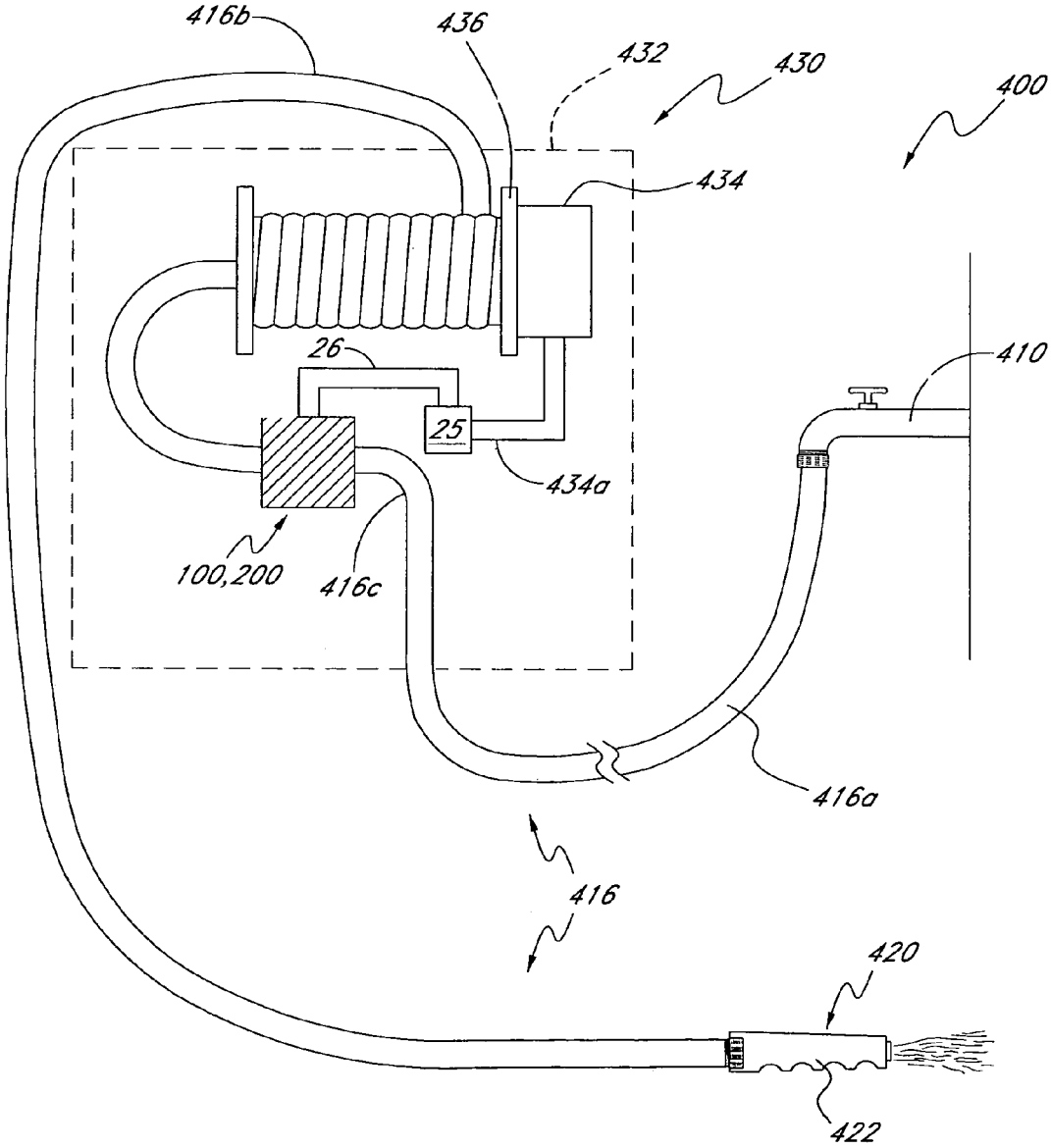
FIG. 5 is a schematic of a generator used to power a hose reel.

FIG. 5 illustrates the use of the generator 100, 200 in a hose control apparatus 400, including a hose reel device 430. The hose reel device 430 includes an electric motor 434 configured to rotate a hose reel drum 436. A first hose section 416*a* of a hose 416 communicates fluid from the pressurized fluid source or faucet 410 to the hose reel device 430. A second hose section 416*b* wraps around the drum 436 and terminates at a distal end 420 in a hose nozzle 422 or attachment device. In one embodiment, the second hose section 416*b* connects to the first hose section 416*a*. In another embodiment, a third hose section 416*c* connects the first hose section 416*a* to the second hose section 416*b*. The apparatus 400 can also include the receiver 40 and antenna 42 (FIG. 4) to receive remote commands for operating the reel device 430.

In a preferred embodiment, at least a portion of the third hose section 416*c* can be the conduit 28 (see FIGS. 1 and 2) to which the generator 100, 200 connects, so that the generator 100, 200 is disposed inside a hose reel housing 432 enclosing the motor 434, the reel drum 436 and the third hose section 416*c*. However, in other embodiments, the generator 100, 200 can be connected to a portion of the hose 416 outside the housing 432.

In one embodiment, the motor 434 can be connected to the battery 25 via at least one wire connection 434*a*, wherein the battery 25 in turn connects to the terminals 20 (see FIGS. 1 and 2) of the generator 100, 200 via electrical wires 26. Accordingly, the generator 100, 200 charges the battery 25, which in turn transmits power to the motor 434 to rotate the reel drum 436. Preferably, the generator 100, 200 charges the battery 25 at least enough to delay the need to remove the battery 25 to fully charge or replace it. The time required to replace the power consumption during a spooling cycle is dependent on a number of factors, including, e.g., water pressure, the total length or weight of the hose, the length of hose unspooled from the reel, the resistance of the hose to spooling or unspooling, etc. For example, if a 12V volt battery with a capacity of about 7 amp-hours is employed, it is expected that water pressure from an average household (e.g., about 40–60 psi) will replenish the power drained from the battery during the reeling of the entire length of a 100 ft. hose by running water through the generator for about 4–6 minutes. In an alternate embodiment, the motor 434 can connect directly to the terminals 20 via the at least one wire connection 434*a*.

Further information on the flow controller 300 and the hose control apparatus 400 can be found in Applicant's U.S. Provisional Patent Application No. 60/455,229, filed Mar. 13, 2003.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

I claim:

1. A system for spooling and unspooling a flexible conduit configured to contain a flow of a pressurized fluid, comprising:

a reel drum onto which the flexible conduit can be spooled;

a generator operatively connected to a flow path within the conduit, the generator configured to receive a pressurized fluid flow therethrough and convert kinetic energy of the pressurized fluid flow into electricity;

a battery operatively connected to the generator and configured to receive and store the electricity; and a motor for selectively driving rotation of the reel drum, the motor being connected to the battery and configured to receive electrical power from the battery.

2. The system of claim 1, wherein the conduit comprises a water hose.

3. The system of claim 1, wherein the pressurized fluid comprises a liquid.

4. The system of claim 1, wherein the pressurized fluid comprises a gas.

5. The system of claim 1, wherein the generator comprises a turbine having a body rotatable about an axis in-line with the flow path within the conduit, the body having a length and at least one vane extending outward from the body and into the flow path, wherein the at least one vane is adapted to receive a force thereon from the fluid flow to rotate about the axis.

6. The system of claim 5, wherein at least one surface of the at least one vane is curved.

7. The system of claim 6, wherein the at least one vane extends substantially continuously along the length of the body.

8. The system of claim 1, wherein the generator comprises an impeller having a body disposed adjacent the flow path within the conduit, the impeller rotatable about an axis and having at least one paddle extending radially outward from the body and into the flow path, the at least one paddle configured to receive a force thereon from the fluid flow to rotate about the axis.

9. The system of claim 1, further comprising an electrical actuator configured to actuate a valve communicating with the flow path to selectively open or close the flow path.

10. The system of claim 9, wherein the valve is configured to permit selective setting of the size of a flow orifice of the flow path to any of a multiplicity of positions between a completely open position and a completely close position.

11. A conduit managing system comprising:

an electrically powered hose reel;

a fluid flow control device including a fluid flow path extending between an inlet and an outlet of the device, an electrically actuated valve disposed in-line with the flow path and configured to selectively open or close the flow path, and electronics configured to actuate the valve;

a generator configured to convert kinetic energy of a pressurized fluid flowing through the flow path into electricity; and an electrical circuit for delivering the electricity from the generator to the fluid flow control device and the hose reel.

12. The conduit managing system of claim 11, further comprising a remote control configured to transmit a signal to the electronics from a remote location to actuate the electrically actuated valve and/or the hose reel.

13. The conduit managing system of claim 11, wherein the electrical circuit comprises a battery storing the electricity from the generator.

14. The conduit managing system of claim 11, wherein the fluid flow control device is configured to permit selective setting of the size of a flow orifice of the flow path to any of a multiplicity of positions between a completely open position and a completely closed position.

15. A hose control system comprising:

a reel for spooling and unspooling a flexible fluid conduit;

a motor connected to the reel to drive rotation of the reel;

an electrically actuated flow control device, the flow control device configured to selectively allow a pressurized fluid flow therethrough; and a generator adapted to harness energy of the pressurized fluid flow to electrically charge a battery connected to both the flow control device and the motor, wherein the battery is configured to provide power to both the flow control device and the motor.

16. A method of spooling a hose, comprising:

providing a flow control device connected to the hose, the device comprising a flow path in communication with the hose and configured to receive a pressurized fluid flow therethrough, the device including an electrically actuated valve in communication with the flow path;

providing a generator, at least a portion of which is disposed in the flow path, the generator configured to convert kinetic energy of the pressurized fluid flow into electrical energy;

charging a battery connected to the generator with the electrical energy; and providing an electrical connection from the battery to a hose reel to electrically power rotation of the hose reel with the battery.

17. The method of claim 16, further comprising selectively actuating the electrically actuated valve with electrical power from the battery to open and close the flow path.

18. The method of claim 17, wherein selectively actuating comprises wirelessly signaling the flow control device.

19. The method of claim 17, wherein selectively actuating comprises receiving a wireless signal for controlling the rotation of the hose reel.

20. A method of reeling or unreeling a hose and regulating a pressurized fluid flow through the hose, the method comprising:

providing a flow control device connected to the hose, the device having a flow path;

harnessing energy of a pressurized fluid flow through the hose to generate electricity;

charging a battery with the electricity;

powering the reeling or unreeling of the hose with the electricity from the battery; and providing the electricity from the battery to the flow control device to selectively allow flow through the flow path.

21. A method for electrically powering a reel from a pressurized fluid flow through a conduit, comprising:

providing a conduit defining a flow path configured to receive the pressurized fluid flow therethrough from a mechanical source;

harnessing energy of the pressurized fluid flow to generate electricity; and powering rotation of the reel using the generated electricity.

22. The method of claim 21, further comprising charging a battery with the generated electricity.

23. The method of claim 21, wherein the mechanical source comprises a pump.

24. The method of claim 21, further comprising operating, with the generated electricity, an electrical device associated with the fluid flow.

25. The method of claim 24, wherein the electrical device comprises a valve capable of selectively opening and closing the flow path.

26. The method of claim 21, wherein powering rotation of the reel comprises providing electrical power to a motor connected to the reel.

* * * * *